US006679229B2

(12) United States Patent
Wada et al.

(10) Patent No.: US 6,679,229 B2
(45) Date of Patent: Jan. 20, 2004

(54) FUEL SUPPLY APPARATUS IN OUTBOARD ENGINE

(75) Inventors: Tetsu Wada, Wako (JP); Tomonori Ikuma, Wako (JP); Jun Kimura, Kawasaki (JP); Fumihiko Sugiura, Kawasaki (JP)

(73) Assignees: Honda Giken Kogyo Kabushiki Kaisha, Tokyo (JP); Keihin Corporation, Tokyo (JP)

( * ) Notice: Subject to any disclaimer, the term of this patent is extended or adjusted under 35 U.S.C. 154(b) by 54 days.

(21) Appl. No.: 10/144,244

(22) Filed: May 10, 2002

(65) Prior Publication Data

US 2002/0166605 A1 Nov. 14, 2002

(30) Foreign Application Priority Data

May 14, 2001 (JP) ..... 2001-143034

(51) Int. Cl.[7] ..... F02M 37/04
(52) U.S. Cl. ..... 123/516; 123/509
(58) Field of Search ..... 123/516, 509, 123/510

(56) References Cited

U.S. PATENT DOCUMENTS 5,103,793 A * 4/1992 Riese et al. ..... 123/516
5,375,578 A * 12/1994 Kato et al. ..... 123/516
5,389,245 A * 2/1995 Jaeger et al. ..... 123/516
5,647,331 A * 7/1997 Swanson ..... 123/516
5,855,197 A * 1/1999 Kato ..... 123/516
6,257,208 B1 * 7/2001 Harvey ..... 123/516
6,422,255 B1 * 7/2002 Hartke et al. ..... 123/516
2002/0100457 A1 * 8/2002 Sakai ..... 123/516

* cited by examiner

*Primary Examiner*—Thomas N. Moulis
(74) *Attorney, Agent, or Firm*—Zito tlp; Joseph J. Zito; Kendal M. Sheets

(57) ABSTRACT

To improve a freedom of layout within a narrow cowling of the outboard engine, achieve a reduction of manufacturing cost and an improvement of a maintenance performance of a filter member, a fuel supply apparatus in an outboard engine is structured such that fuel within a fuel tank is supplied into a vapor separator (V) via a low pressure fuel pump, the fuel stored within the vapor separator (V) is pressurized by a high pressure fuel pump (P) and is supplied to a fuel injection valve via a filter, a pump case (10) receiving the high pressure fuel pump (P) is arranged in a side portion of the vapor separator (10), an upper opening thereof is fixed by a cover member (14), a fuel discharge passage (15) connected to a pump discharge passage (PB) of the high pressure fuel pump (P) and a filter receiving recess portion (16) connected to the fuel discharge passage (15) are formed in the cover member (14), and a filter member (17) is detachably arranged in the filter receiving recess portion (16).

3 Claims, 2 Drawing Sheets

【Fig. 1】
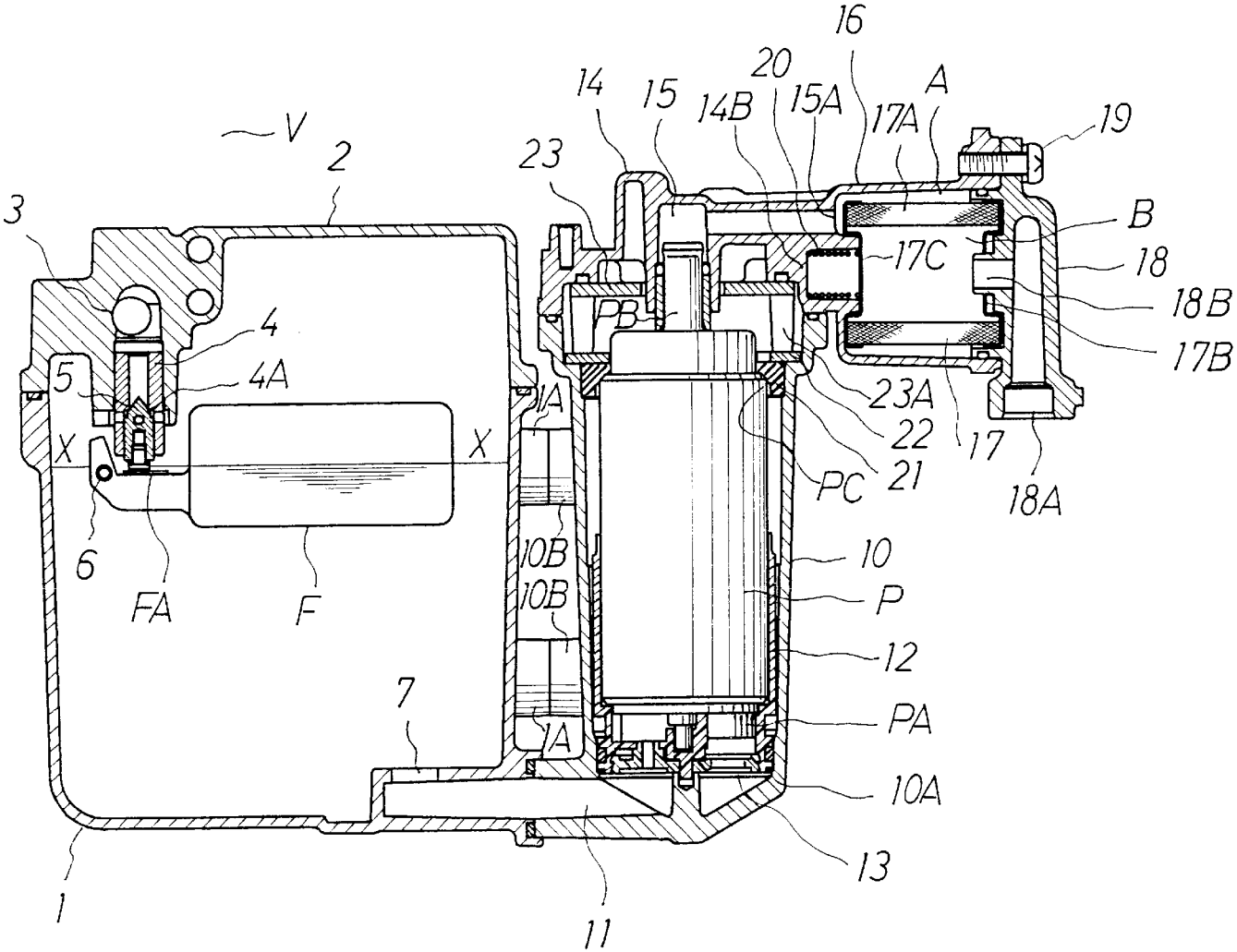

【Fig. 2】
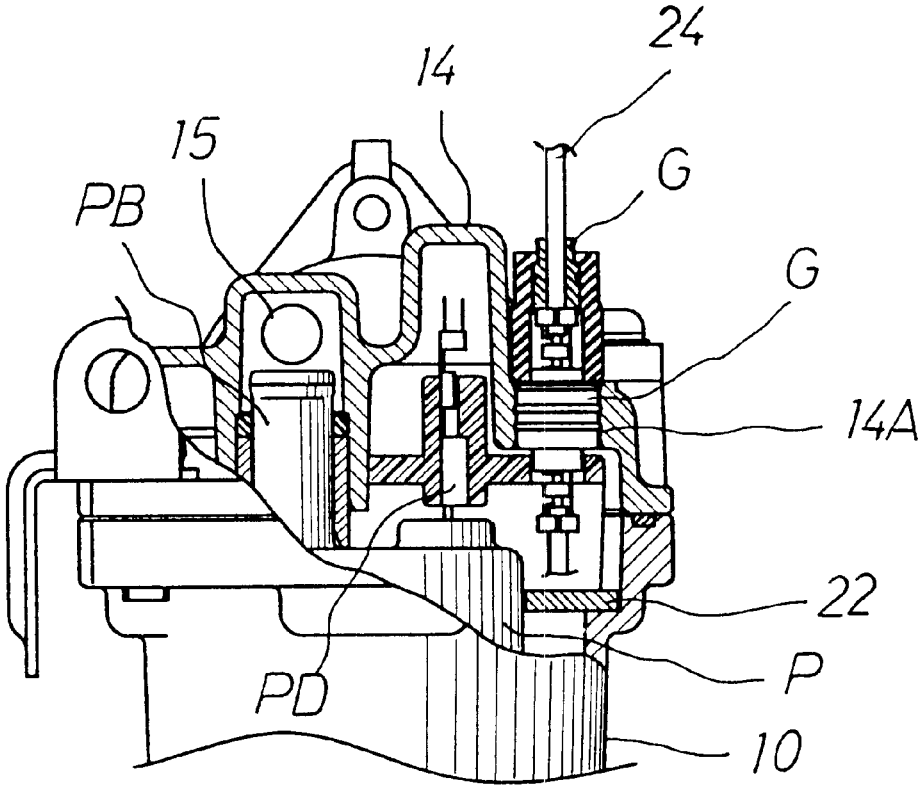

FUEL SUPPLY APPARATUS IN OUTBOARD ENGINE

BACKGROUND OF THE INVENTION

1. Field of the Invention

The present invention relates to a fuel supply apparatus in an outboard engine which supplies a fuel within a fuel tank into a vapor separator by a low pressure fuel pump, increases a pressure of the fuel with a fixed fuel liquid surface stored within the vapor separator by a high pressure fuel pump, and supplies the fuel having the increased high pressure to an engine via a fuel injection valve attached to a fuel distributing pipe, and more particularly to a filter which removes foreign materials contained in the fuel discharged from the high pressure fuel pump.

2. Description of the Prior Art

In conventional, the filter which removes the foreign materials contained in the fuel discharged from the high pressure fuel pump is structured such that a filter in which a filter member is received and arranged within a filter case is independently prepared, and the filter is arranged within a fuel piping which connects a pump discharge passage of the high pressure fuel pump with the fuel distributing pipe.

Further, the filter is structured such that a filter case constituted by an upper case and a lower case being firmly coupled and fixed in accordance with caulking, welding or the like, a filter member is received and arranged within a space portion of the filter case formed thereby, and pipes corresponding to fuel passages open to the interior of the space portion are integrally formed with the upper case and the lower case.

In accordance with the fuel supply apparatus using the filter mentioned above, firstly, a freedom of layout design within a cowling of the outboard engine is hindered. Secondly, it is impossible to effectively reduce a manufacturing cost of the fuel supply apparatus. That is, since the filter is independently prepared, and the filter should be received within the cowling surrounding a periphery of the engine in the outboard engine, a special consideration is required for arranging the filter within the narrow cowling.

Further, in placing the filter, it is necessary to mount the filter to a fixed portion of the engine or the like via a mounting member such as a stay or the like, and a consideration is required for arranging the stay.

Further, the filter requires the upper case and the lower case to forming the space portion for receiving the filter member, the number of the parts is increased and an operation for firmly coupling fixing them is required, so that it is impossible to effectively reduce the manufacturing cost.

Further, the filter requires an operation for connecting respective pipes constituting a fuel inlet and a fuel outlet which extend from an end portion of the filter to an interior portion of the fuel piping, and since an assembly operation within the narrow placing space is hard, it is impossible to reduce an assembling man hour.

Further, there is a case that the fuel inlet and the fuel outlet are connected in an erroneous connecting direction at this time, and it is necessary to execute this connecting operation carefully.

Further, since the upper case and the lower case are firmly coupled and fixed, it is significantly hard to execute a maintenance operation of the filter member received inside. Actually, the case is broken and it is impossible to reuse the case.

SUMMARY OF THE INVENTION

A fuel supply apparatus in an outboard engine in accordance with the present invention is made by taking the problems mentioned above into consideration, and an object of the present invention is to provide a fuel supply apparatus in an outboard engine which can improve a freedom of layout within a narrow cowling, achieve a reduction of manufacturing cost and improve a maintenance performance of a filter member.

In accordance with a first aspect of the present invention, in order to achieve the object mentioned above, there is provided a fuel supply apparatus in an outboard engine which supplies a fuel within a fuel tank into a vapor separator by a low pressure fuel pump, and increases a pressure of the fuel stored within the vapor separator by a high pressure fuel pump so as to supply to an engine via a fuel injection valve, characterized in that a pump case receiving the high pressure fuel pump is arranged in a side portion of the vapor separator, within which a fixed fuel liquid surface X—X is formed, a fuel discharge passage connected to a pump discharge passage of the high pressure fuel pump and a filter receiving recess portion connected to the fuel discharge passage are provided in a cover member closing an upper opening of the pump case, and a filter member is detachably arranged in the filter receiving recess portion.

Further, in accordance with a second aspect of the present invention, in addition to the first aspect mentioned above, the filter member is arranged within the filter receiving recess portion so as to be elastically pressed via an elastic member.

Further, in accordance with a third aspect of the present invention, in addition to the first aspect mentioned above, a lead wire of the high pressure fuel pump received within the pump case is extended to the external via the cover member.

In accordance with the first aspect, since the filter receiving recess portion which receives the filter member is integrally formed with the cover member, and the mounting member such as the stay or the like for placing the filter within the cowling is not required, it is possible to improve a freedom of arranging the filter within the cowling. Further, since a part of the case serves commonly as the cover member, and the connection to the fuel piping is unified, it is possible to reduce the number of the parts and it is possible to shorten a connecting operation, whereby it is possible to reduce a manufacturing cost. Further, since the filter member is detachably arranged in the filter receiving recess portion, it is possible to improve a maintenance performance of the filter member.

Further, in accordance with the second aspect, since the filter member is arranged so as to be elastically pressed by the elastic member within the filter receiving recess portion, it is possible to stably support the filter member within the filter receiving recess portion without being bumpy, at a time of operating the engine or the like.

Further, in accordance with the third aspect, since the lead wire is supported by the cover member which closes the upper opening of the pump case, it is possible to arrange a grommet or the like which elastically supports the lead wire in an airtight manner, in this cover member.

BRIEF DESCRIPTION OF THE DRAWINGS

FIG. 1 is a vertical cross sectional view showing an embodiment of a fuel supply apparatus in an outboard engine in accordance with the present invention; and FIG. 2 is a vertical cross sectional view of a main portion showing an electric connection of a high pressure fuel pump in FIG. 1.

DESCRIPTION OF THE PREFERRED EMBODIMENT

A description will be given below of an embodiment of a fuel supply apparatus in an outboard engine in accordance with the present invention with reference to FIG. 1. Reference numeral V denotes a vapor separator, which is constituted by the following elements. Reference numeral 1 denotes a vapor separator main body having an open upper portion and formed in a cup shape. The main body is closed by a vapor separator cover 2. A low pressure fuel flow passage 3 opens to the vapor separator cover 2 so as to face to the interior of the vapor separator main body 1, a valve seat 4 is arranged in this open end, and a float valve 5 which opens and closes a valve seat 4A is movably arranged in the valve seat 4. A float F is rotatably supported to a shaft 6 with a float arm FA and arranged within the vapor separator main body 1, and the float arm FA is arranged so as to be brought into contact with a lower end of the float valve 5.

The upstream side (upstream and downstream are called in a flow direction of the fuel) of the low pressure fuel flow passage 3 is connected to the interior of a fuel tank (not shown), and a low pressure fuel pump such as a mechanical diaphragm pump (not shown) or the like is arranged to the low pressure fuel flow passage 3. In this case, when the low pressure fuel pump starts driving, the fuel within the fuel tank is sucked into the low pressure fuel pump, and the low pressure fuel having a pressure increased to a low pressure is supplied into the vapor separator main body 1 via the low pressure fuel flow passage 3 and the valve seat 4. Further, when the low pressure fuel is supplied into the vapor separator main body 1 and an amount thereof is gradually increased, the float F gradually rotates in the counterclockwise direction on the basis of the shaft 6, and when a fixed fuel liquid surface X—X is formed within the vapor separator main body 1, the float arm FA brings the float valve 5 into contact with the valve seat 4A so as to stop the fuel supply of the fuel from the valve seat 4.

On the contrary, when the fuel is consumed from a fuel discharge hole T open to a lower portion of the vapor separator main body 1 and the fuel liquid surface within the vapor separator main body 1 becomes low, the float F rotates in the clockwise direction on the basis of the shaft 6 in correspondence thereto, and the float valve 5 again opens the valve seat 4, whereby the low pressure fuel is again supplied into the vapor separator main body 1 from the low pressure fuel flow passage 3.

Thereafter, an opening and closing operation of the valve seat 4 is continuously executed by the float valve 5 in correspondence to the fuel liquid surface height within the vapor separator main body 1, whereby the fixed fuel liquid surface X—X is always formed within the vapor separator main body 1.

Reference numeral 10 denotes a pump case having an open upper portion and formed in a cup shape. A fuel inflow passage 11 opens to a lower bottom portion of the pump case 10.

Reference symbol P denotes a known high pressure fuel pump. A pump suction passage PA opens to a lower portion of the high pressure fuel pump P in a protruding manner, and a pump discharge passage PB opens to an upper portion thereof in a protruding manner.

Reference numeral 12 denotes a supporting tube portion arranged in a lower outer periphery of the high pressure fuel pump P and formed in a notched cylindrical shape. A disc-shaped pump strainer 13 is arranged in a lower end of the supporting tube portion 12.

Reference numeral 14 denotes a cover member which closes an upper opening of the pump case 10. A fuel discharge passage 15, to which the pump discharge passage PB of the high pressure fuel pump P is inserted and supported, is provided upward, and a filter receiving recess portion 16 is provided so as to be open sideward in the cover member 14. Further, the fuel discharge passage 15 and an inner bottom portion of the filter receiving recess portion 16 are connected by the upper end of the fuel discharge passage 15 turning to the right in the drawing.

The high pressure fuel pump P and a filter member 17 are arranged in the pump case 10 and the cover member 14 structured as mentioned above, in the following manner.

At first, the filter member 17 is arranged in the cover member 14.

The filter member 17 is structured such that plate-shaped retainers 17B and 17C are arranged in both side ends of a tubular filter paper 17A, the filter member 17 is inserted to and arranged within the filter receiving recess portion 16 from an opening portion in the right side of the filter receiving recess portion 16A, and is screwed with a filter cover 18 and the cover member 14 by a screw 19, whereby the opening portion in the right side of the filter receiving recess portion 16 is closed.

In accordance with the structure mentioned above, the filter member 17 is received and arranged within the filter receiving recess portion 16, and a downstream end 15A of the fuel discharge passage 15, which opens to the interior of the filter receiving recess portion 16, opens to the interior of a first chamber A formed outside the filter member 17.

On the other hand, an upstream end 18B of a second fuel discharge passage 18A formed in the filter cover 18 is arranged so as to open toward the interior of a second chamber B formed in a inside the filter member 17.

Further, the right end of an elastic member 20 such as a coil spring or the like, which is provided within a recess portion 14B in a compressed manner is arranged so as to be brought into contact with the left side surface of a retainer 17C in the left side in the drawing, whereby the filter member 17 is arranged so as to be elastically pressed toward the filter cover 18.

Next, the high pressure fuel pump P is received and arranged within the pump case 10.

Prior to this, at first, the supporting tube portion 12, to which the pump strainer 13 is fitted and arranged, is attached to a lower outer periphery of the high pressure fuel pump P. In accordance with this structure, the supporting tube portion 12 is arranged so as to surround the lower outer periphery of the high pressure fuel pump P, the pump strainer 13 is arranged at the lowermost position with respect to the high pressure fuel pump P, and the pump intake passage PA is arranged to open at the upper position of the pump strainer 13.

Then, the high pressure fuel pump P provided with the pump strainer 13 and the supporting tube portion 12 is inserted to and arranged within the pump case 10 from the upper opening portion of the pump case 10.

Next, an annular elastic member 21 formed by a rubber material, a flat plate portion 22 and a flat plate portion 23, on which a leg portion 23A is provided uprightly, are arranged on a shoulder portion in the upper side of the high pressure fuel pump P.

Next, the cover member 14 is arranged in an upper opening portion of the pump case 10, and the pump discharge passage PB of the high pressure fuel pump P is inserted to and arranged within the fuel discharge passage 15 of the cover member 14 at this time.

Then, the cover member 14 is screwed and fixed to the pump case 10 under the state mentioned above. In accordance with the structure mentioned above, the high pressure fuel pump P is held so as to be pressed toward a step portion 10A provided in the lower side of the pump case 10 via the elastic member 21, the flat plate portion 22 and the flat plate portion 23 provided with the leg portion 23A in the longitudinal axial direction thereof, and on the other hand, the outer peripheral portion of the high pressure fuel pump P is held so as to be pressed by the supporting tube portion 12 and the annular elastic member 21.

On the other hand, at a time of fixing the cover member 14 mentioned above to the pump case 10, a lead wire 24 connected to a terminal PD of the high pressure fuel pump P extends to the external through an insertion hole 14A provided so as to pass through the cover member 14, and a grommet G made of a rubber material for preventing a water from intruding into the cover member 14 from the external is arranged in an outer periphery of the lead wire 24. This is well shown in FIG. 2.

As mentioned above, the cover member 14, within which the filter member 17 is detachably received and arranged, is firmly fixed to the pump case 10, within which the high pressure fuel pump P is received, and the pump case 10 and the vapor separator main body 1 are screwed and firmly fixed to each other via connection protruding portions 1A and 10B respectively provided therein in an opposing manner. (Here, the screw is not illustrated.)

In this case, at a time of connecting the vapor separator main body 1 to the pump case 10, the fuel inflow passage 11 of the pump case 10 and the fuel discharge port T of the vapor separator main body 1 are connected.

In accordance with the structure mentioned above, the pump case 10 is fixed and arranged to a side portion of the vapor separator main body 1, they are arranged within an engine cowling (not shown) surrounding the periphery of the engine, further the low pressure fuel flow passage 3 of the vapor separator V is connected to the fuel tank, and the second fuel discharge passage 18A provided in the filter cover 18 of the cover member 14 is connected to a fuel distribution pipe, to which a fuel injection valve (not shown) is attached, via a fuel piping.

In accordance with the fuel supply apparatus provided with the vapor separator V, the high pressure fuel pump P and the filter member 17 which are formed in the manner mentioned above, the fuel supply is executed at a time of operating the engine in the following manner.

When the drive operation of the engine is executed, and an electric current is supplied to the high pressure fuel pump P from an ECU (not shown) via the lead wire 24, the high pressure fuel pump P sucks the fuel stored within the vapor separator V into the pump chamber via the fuel discharge hole 7, the fuel inflow passage 11, the pump strainer 13 and the pump intake passage PA, and the high pressure fuel having the pressure increased within the pump chamber is discharged toward the fuel discharge passage 15 via the pump discharge passage PB.

In the fuel flow mentioned above, the foreign matters in the fuel moving toward the high pressure fuel pump P from the vapor separator V are removed by the pump strainer 13.

Then, the fuel having the increased pressure within the fuel discharge passage 15 is supplied into the first chamber A within the filter receiving recess portion 16 from the downstream end 15A thereof, and the fuel within the first chamber A flows into the second chamber B inside the filter member 17 via the filter member 17.

Accordingly, the foreign materials in the fuel flowing into the second chamber B are removed by the filter member 17, and the foreign materials existing within the first chamber A from the high pressure fuel pump P are all removed by the filter member 17, whereby a clean fuel is supplied into the second chamber B. Then, the fuel within the second chamber B is supplied to the fuel distribution pipe, to which the fuel injection valve is attached, via the second fuel discharge passage 18A provided in the filter cover 18, and the high pressure fuel is supplied toward the engine from the fuel injection valve, whereby the operation of the engine is executed.

As mentioned above, in accordance with the fuel supply apparatus in the outboard engine, since the filter member 17 is received and arranged within the filter receiving recess portion 16 provided in the cover member 14 in a recessed manner, the upper case and the lower case for independently receiving the filter member are not required, and it is not necessary to fix the filter via the mounting stay, so that it is possible to widely improve the freedom of arranging the filter within the narrow cowling in the outboard engine.

Further, it is possible to use the portion corresponding to the lower case in the conventional filter commonly as the cover member 14, it is possible to reduce the number of the parts.

Further, it becomes significantly easy to arrange the fuel piping in the filter. This is because the piping connection can be completed only by simply connecting the second fuel discharge port 18A provided in the filter cover 18 to the fuel piping extending toward the fuel distribution pipe.

Further, in accordance with the structure mentioned above, it is possible to completely eliminate the risk of an erroneous connection between the fuel inlet and the fuel outlet in the filter in an erroneous connecting direction, and it is possible to widely improve a connecting operability.

Further, in accordance with the present invention, since the filter member 17 is arranged within the filter receiving recess portion 16 and it is possible to attach and detach the filter member 17 to and from the cover member 14 by removing the filter cover 18, it is possible to widely improve a maintenance operability with respect to the clogging of the filter member 17.

Further, in the structure mentioned above, when it becomes impossible to reuse the filter member 17, only the filter member 17 may be simply replaced.

Further, in accordance with the structure, in which the filter member 17 arranged within the filter receiving recess portion 16 is held so as to be elastically pressed toward the filter cover 18 by the elastic member 20, it is possible to prevent the filter member 17 from being bumpy, for example, it is possible to restrict a generation of abrasion or the like caused by a contact of the retainers 17B and 17C.

In this case, the elastic member 20 may be a leaf spring or a rubber cushion in place of the coil spring, in short, a member having an elastic function may be used, and the layout thereof is not limited to the present embodiment.

Further, in the case of extending the lead wire 24 connected to the terminal PD of the high pressure fuel pump P to the external via the insertion hole 14A provided in the cover member 14, since it is possible to extend out the lead wire 24 from the insertion hole 14A of the cover member 14 positioned near the terminal PD protruding on the upper side of the high pressure fuel pump P, it is possible to make the electronic connection portion short, and the grommet G supporting the lead wire 24 to the insertion hole can be easily arranged.

As mentioned above, in accordance with the fuel supply apparatus in the outboard engine of the present invention, since the pump case receiving the high pressure fuel pump is arranged in the side portion of the base separator, within which the fixed fuel liquid surface X—X is formed, the fuel discharge passage connected to the pump discharge passage of the high pressure fuel pump and the filter receiving recess portion connected to the fuel discharge passage are provided in the cover member closing the upper opening of the pump case, and the filter member is detachably arranged in the filter receiving recess portion, it is possible to widely improve a freedom of arranging the filter provided with the filter member within the cowling, it is possible to reduce the number of the parts, it is possible to improve the connecting operability to the fuel piping, and it is possible to completely restrict the erroneous assembly at a time of connection.

In particular, since the filter member is detachably arranged in the filter receiving recess portion, it is possible to widely improve the maintenance operability of the filter member, and since it is possible to replace only the filter member even when the filter member can not be reused, it is possible to attain an excellent economic effect.

Further, in accordance with the structure in which the filter member is arranged within the filter receiving recess portion so as to be pressed via the elastic member, it is possible to prevent the filter member from being bumpy, it is possible to prevent the filter member from being abraded or deformed, and it is possible to keep a stable filter performance for a long time.

Further, in accordance with the structure, in which the lead wire connected to the terminal of the high pressure fuel pump extends to the external via the cover member 14, it is possible to effectively execute the electric connection of the high pressure fuel pump within a significantly short range, and it is possible to easily arrange the grommet around the lead wire.

What is claimed is:

1. A fuel supply apparatus in an outboard engine which supplies a fuel within a fuel tank into a vapor separator by a low pressure fuel pump, and increases a pressure of the fuel stored within the vapor separator by a high pressure fuel pump so as to supply to an engine via a fuel injection valve, characterized in that a pump case (10) receiving the high pressure fuel pump (P) is arranged in a side portion of the vapor separator (V) within which a fixed fuel liquid surface (X—X) is formed, a fuel discharge passage (15) connected to a pump discharge passage (PB) of the high pressure fuel pump (P) and a filter receiving recess portion (16) connected to the fuel discharge passage are provided in a cover member (14) closing an upper opening of the pump case, and a filter member (17) is detachably arranged in the filter receiving recess portion (16).

2. A fuel supply apparatus in an outboard engine as claimed in claim 1, wherein the filter member is arranged within the filter receiving recess portion (16) so as to be elastically pressed via an elastic member (20).

3. A fuel supply apparatus in an outboard engine as claimed in claim 1, wherein a lead wire (24) of the high pressure fuel pump (P) received within the pump case is extended to the external via the cover member (14).

* * * * *